US008373558B2

(12) United States Patent
Sagady et al.

(10) Patent No.: US 8,373,558 B2
(45) Date of Patent: Feb. 12, 2013

(54) DEVICES AND METHODS FOR PROVIDING CASHLESS PAYMENT AND DIAGNOSTICS FOR VENDING MACHINES

(75) Inventors: Cary Sagady, Chester Springs, PA (US); Joseph Simpkins, West Chester, PA (US)

(73) Assignee: USA Technologies, Inc., Malvern, PA (US)

( * ) Notice: Subject to any disclaimer, the term of this patent is extended or adjusted under 35 U.S.C. 154(b) by 656 days.

(21) Appl. No.: 12/576,473

(22) Filed: Oct. 9, 2009

(65) Prior Publication Data

US 2010/0094458 A1 Apr. 15, 2010

Related U.S. Application Data

(63) Continuation-in-part of application No. 12/249,163, filed on Oct. 10, 2008.

(51) Int. Cl.
*G08B 21/00* (2006.01)

(52) U.S. Cl. ..... 340/540; 340/539.22; 700/244

(58) Field of Classification Search ..... 700/231, 700/236, 244; 340/540, 545.1, 568.1, 584, 340/654, 539.1, 539.16, 539.17, 539.22, 340/539.24, 539.27

See application file for complete search history.

(56) References Cited

U.S. PATENT DOCUMENTS

| | | | | |
|---|---|---|---|---|
| 4,412,292 | A * | 10/1983 | Sedam et al. | 340/545.1 |
| 5,844,808 | A * | 12/1998 | Konsmo et al. | 700/244 |
| 5,959,869 | A | 9/1999 | Miller | |
| 6,119,053 | A | 9/2000 | Taylor | |
| 6,339,731 | B1 | 1/2002 | Morris | |
| 6,457,038 | B1 | 9/2002 | Defosse | |
| 6,505,095 | B1 | 1/2003 | Kolls | |
| 6,839,610 | B2 | 1/2005 | Carstens | |
| 7,131,575 | B1 | 11/2006 | Kolls | |
| 7,167,892 | B2 | 1/2007 | Defosse | |
| 7,171,451 | B2 | 1/2007 | Defosse | |
| 7,523,182 | B2 | 4/2009 | Godwin | |
| 7,865,430 | B1 | 1/2011 | Kolls | |
| 8,005,425 | B2 | 8/2011 | Defosse | |
| 2002/0156727 | A1 | 10/2002 | LeVake et al. | |
| 2003/0158625 | A1 | 8/2003 | Carstens | |
| 2005/0043011 | A1 * | 2/2005 | Murray et al. | 455/405 |
| 2006/0247824 | A1 | 11/2006 | Walker | |
| 2007/0050465 | A1 | 3/2007 | Canter | |
| 2007/0083287 | A1 | 4/2007 | Defosse et al. | |
| 2007/0227856 | A1 | 10/2007 | Gopel | |
| 2008/0243566 | A1 | 10/2008 | Godwin | |
| 2009/0013028 | A1 | 1/2009 | Canter et al. | |
| 2009/0113038 | A1 | 4/2009 | Godwin | |
| 2009/0306819 | A1 | 12/2009 | Insolia | |

FOREIGN PATENT DOCUMENTS

| | | |
|---|---|---|
| WO | 9618980 | 6/1996 |
| WO | 2004051583 | 6/2004 |

OTHER PUBLICATIONS

NAMA, Multi-Drop Bus/Internal Communication Protocol, Version 2.0, Oct. 4, 2000. EVA—DTS (European Vending Association Data Transfer Standard, Release 5.0, Jul. 1999.

International Search Report for PCT/US2009/060129 dated May 11, 2010.

Multi-Drop Bus/Internal Communication Protocol (MDB/ICP) version 3.0 supported by National Automatic Merchandising Association (NAMA) dated Mar. 6, 2003.

The European Vending Association Data Transfer Standard, European Vending Association, Apr. 2008, Version 6.1.

* cited by examiner

*Primary Examiner* — Thomas Mullen

(74) *Attorney, Agent, or Firm* — RatnerPrestia

(57) ABSTRACT

Devices and methods for generating an alert for a vending machine are disclosed. A method of generating an alert includes monitoring a bus for at least one communication from the vending machine controller via the bus. The bus is then monitored for a response to the communication from a peripheral device to the vending machine controller via the bus. The response from the peripheral device is then processed. An alert is then generated based on the processed response. A peripheral device for generating the alert includes a bus interface configured to receive data from the bus and to transmit data onto the bus, and a processing unit coupled to the bus interface, the processing unit configured to process data received from the at least one other peripheral device and generate an alert based on the processed data.

19 Claims, 12 Drawing Sheets

DEVICES AND METHODS FOR PROVIDING CASHLESS PAYMENT AND DIAGNOSTICS FOR VENDING MACHINES

This application is a continuation-in-part of U.S. patent application Ser. No. 12/249,163, entitled "DEVICES AND METHODS FOR PROVIDING CASHLESS PAYMENT AND DIAGNOSTICS FOR VENDING MACHINES," filed Oct. 10, 2008.

FIELD OF THE INVENTION

The present invention relates to the field of vending and, more particularly, to devices and methods for providing cashless payment and diagnostic information for vending machines.

BACKGROUND OF THE INVENTION

Vending machines are often used to vend items and/or services to consumers in locations where it would be impractical or inefficient to staff human beings to provide the items/services. Because vending machines are typically located where the vendor cannot constantly monitor their operations, vendors rely on operation information stored by the vending machines in the vending machines' memory, such as diagnostic information for peripheral devices (e.g., coin acceptors/changers and bill validators/acceptors). A Digital Exchange ("DEX") interface is the current industry standard for gathering stored information by a vending machine.

SUMMARY OF THE INVENTION

The present invention is embodied in a peripheral device for a vending machine, a method of communicating with a vending machine, a vending system, a computer readable storage medium including software that is adapted to control a computer to implement a method of communicating with a vending machine, and devices and methods for generating an alert for a vending machine. According to one aspect of the present invention, the peripheral device may include a bus interface and a processor coupled to the bus interface. The bus interface may receive data from a bus and transmit data onto the bus. The processor may enable cashless payment for the vending machine and provide diagnostic information for at least one other peripheral device based on data received from the at least one other peripheral device via the at least one bus interface over the bus. The peripheral device may also include a transmitter, which may transmit cashless payment information and diagnostic information to a remote processing unit.

According to another aspect of the present invention, a method of generating an alert for a vending machine having a vending machine controller is disclosed. The method includes monitoring a bus for a communication from the vending machine controller via the bus. The bus is then monitored for a response to the communication from a peripheral device to the vending machine controller via the bus. The response from the peripheral device is then processed. An alert is then generated based on the processed response.

According to yet another aspect of the present invention, a method of generating an alert for a vending machine having a vending machine controller is disclosed. The method includes monitoring a bus for at least one communication from the vending machine controller via the bus. The at least one communication from the vending machine controller is then processed. An alert is then based on the processed communication.

According to still another aspect of the present invention, a peripheral device is disclosed for use with a vending machine having a vending machine controller, at least one other peripheral device, and a bus interconnecting the vending machine controller and the at least one other peripheral device. The peripheral device includes a bus interface configured to receive data from the bus and to transmit data onto the bus, and a processing unit coupled to the bus interface, the processing unit configured to process data received from the at least one other peripheral device and generate an alert based on the processed data.

BRIEF DESCRIPTION OF THE DRAWINGS

The invention is best understood from the following detailed description when read in connection with the accompanying drawings, with like elements having the same reference numerals. When a plurality of similar elements is present, a single reference number may be assigned to the plurality of similar elements with a small letter designation referring to specific elements. When referring to the elements collectively or to a non-specific one or more of the elements, the small letter designation may be dropped. Included in the drawings are the following figures.

DETAILED DESCRIPTION OF THE INVENTION

Figure 1:
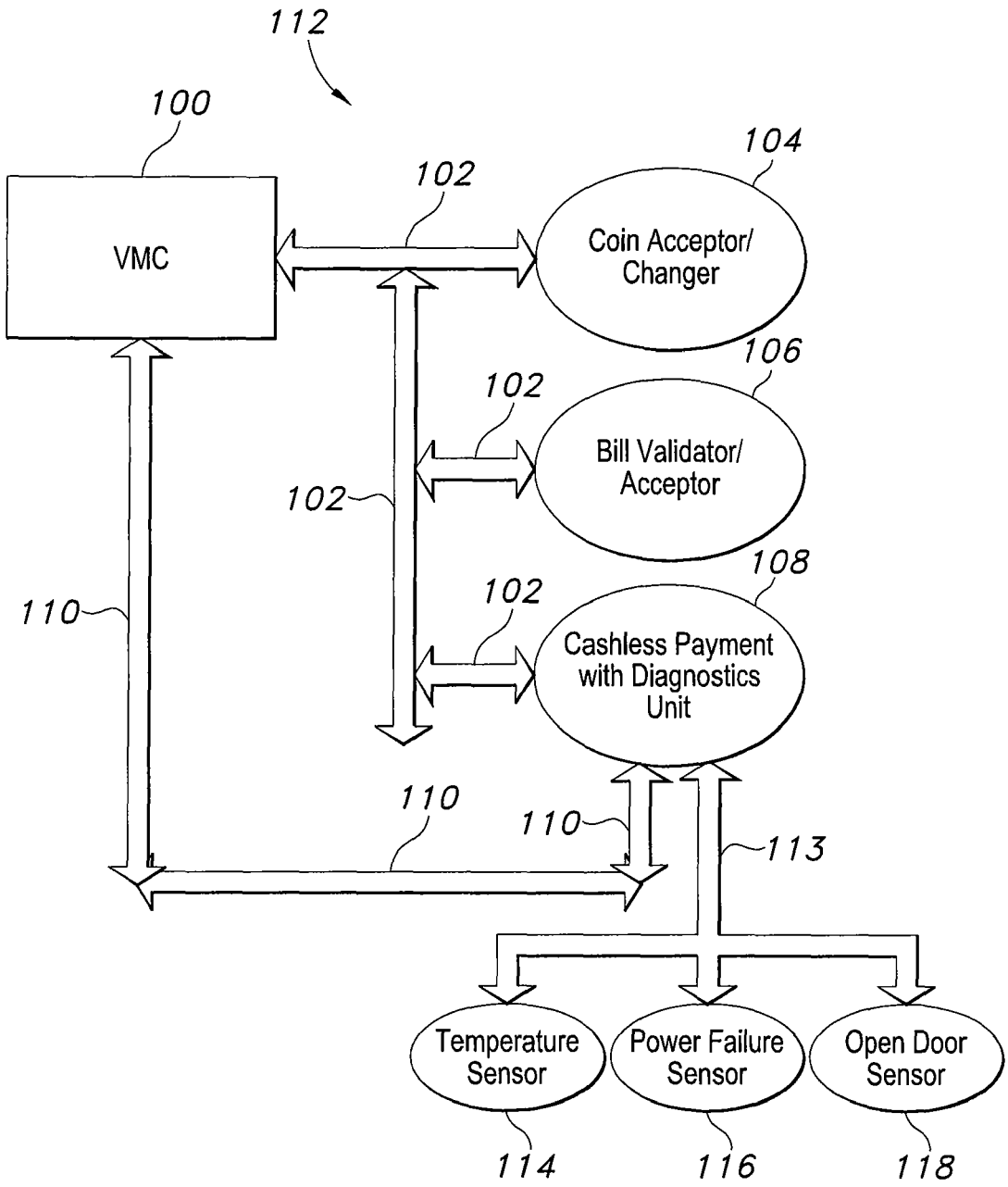
FIG. 1 is a block diagram of a vending system according to an exemplary embodiment of the present invention.

FIG. 1 is a block diagram of a vending system 112 for use in a vending machine according to an exemplary embodiment. The illustrated vending system 112 includes a first bus 102, a second bus 110, a vending machine controller ("VMC") 100, a coin acceptor/changer 104, a bill validator/acceptor 106, and a cashless payment with diagnostics unit ("CPD") 108. The vending system 112 may additionally include other devices, such as sensors that sense a parameter associated with the vending machine (referred to herein as "vending machine sensors"). Example vending machine sensors may include a temperature sensor 114, a power failure sensor 116 (e.g., a power relay), and/or an open door sensor 118 (e.g., a proximity switch), which are described in further detail below. These devices may communicate with the CPD 108 via a separate connection 113 and/or via the busses 102/110. Suitable buses, VMCs, coin acceptors/changers, and bill validators/acceptors will be understood by one of ordinary skill in the art from the description herein.

In one embodiment, the first bus 102 is a multi-drop bus ("MDB"). The bus 102, however, may be any other type of bus suitable for use in a vending system including, for example, a universal serial bus ("USB") or an executive bus. The second bus 110 may include, for example, DEX interfaces, systems and infrastructure (hereinafter collectively referred to as "DEX"). The second bus 110 is not necessary for overall operation of the vending system 112 and may be omitted from the vending system 112 in some embodiments (e.g., if the bus 102 provides all necessary information to the CPD 108). In an exemplary embodiment, the MDB and the DEX operate in accordance with the National Automatic Merchandising Association (NAMA) Multi-Drop Bus/Internal Communication Protocol (MDB/ICP) version 3.0 and the European Vending Association (EVA) Data Transfer Standard (DTS) version 6.1, respectively, each of which are incorporated fully herein by reference.

The coin acceptor/changer 104, the bill validator/acceptor 106 and the CPD 108 are examples of VMC 100 "peripheral devices," one or more of which may be included in the vending system 112. The peripheral devices are not intended to be limited to the examples shown in FIG. 1, however, and may include one or more of a multitude of other vending peripheral devices (e.g., sensors). The coin acceptor/changer 104, the bill validator/acceptor 106 and the CPD 108 are components which enable a user to pay for items in a vending machine. By way of example, the coin acceptor/changer 104 may accept coins and provide change where required, the bill validator/acceptor 106 may accept and validate paper currency, and the CPD 108 may accept credit cards, debit cards, gift cards and other forms of non-currency payment ("cashless payment") via a card acceptor (not shown). The CPD 108 may also communicate with external resources/devices, for example, to obtain pre-authorizations and transmit payment requests.

The VMC 100 is a controller for the vending machine and, as such, controls functions of the vending machine. One such function is a data gathering function. In an exemplary embodiment, the VMC 100 performs the data gathering function by generating/issuing an information command requesting information from a particular peripheral device, addressing it to the particular peripheral device, and placing it on the bus 102. Each peripheral device receives and processes the information command to determine whether the command is addressed to that peripheral device (e.g., by parsing a header associated with the command to identify a destination address for the command). If the information command is addressed to the peripheral device that is processing the command, that peripheral device responds to the command (e.g., with a message). The VMC 100 then receives and stores the response (or "data"). The stored data from the VMC 100 may be retrieved manually via DEX (e.g., over the bus 110). DEX interfaces, systems and infrastructure, however, are complex and expensive. Further, data retrieved via DEX is typically only retrieved periodically (e.g., once per day). Accordingly, it may be desirable to not use DEX at all or to use DEX in combination with MDB data in order to more quickly collect and disseminate diagnostic data. In addition, it may be desirable to collect diagnostic data not available via DEX, such as the real-time state of a peripheral device, for example.

As described above, the CPD 108 is configured to communicate with external devices. The embodiments of the present invention described herein take advantage of this feature of the CPD 108. More specifically, the CPD 108 is configured to intercept and store responses (or data) sent by peripheral devices to the VMC 100 and to transmit the responses to a remote location, thereby eliminating the need for the VMC 100 to transmit the diagnostic communications using the DEX interface 110. Alternatively, MDB and DEX data may both be used to more quickly collect and disseminate diagnostic data while preserving the ability to use potentially useful DEX data to diagnose the vending system (e.g., information regarding columns being empty, how many times the door opens and temperature readings).

Figure 2:
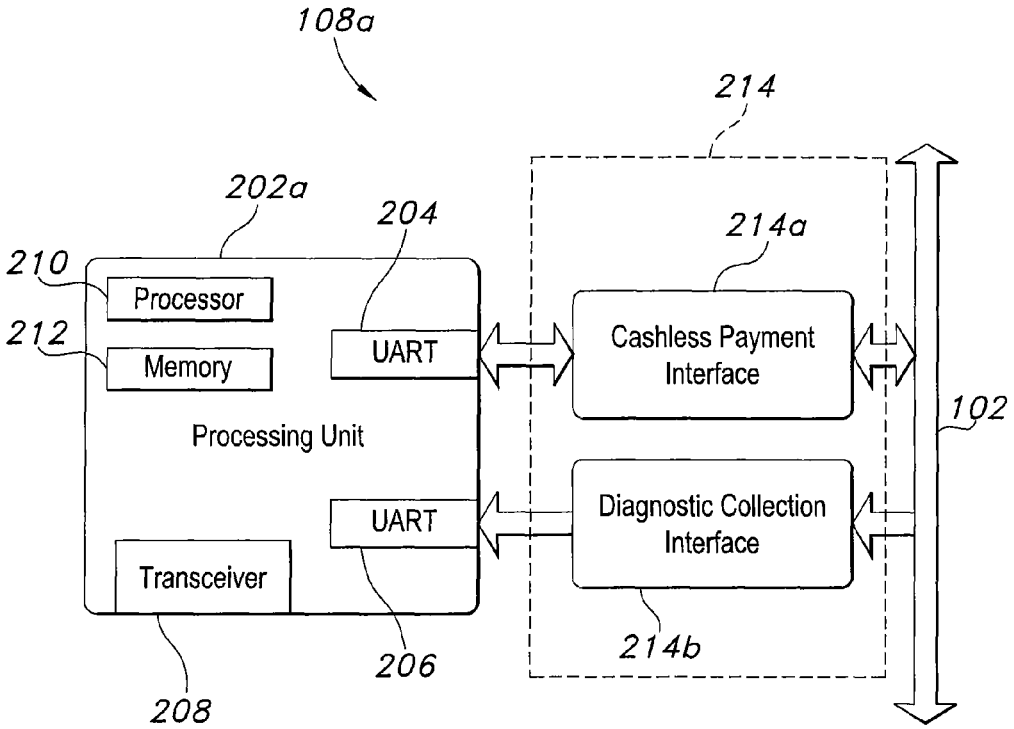
FIG. 2 is a block diagram of a cashless payment with diagnostics unit according to an exemplary embodiment of the present invention.

FIG. 2 is a block diagram of an exemplary CPD 108*a*. The illustrated CPD 108*a* includes a processing unit 202*a* and a bus interface 214. The illustrated processing unit 202*a* includes a processor 210, a memory 212, a transceiver 204 for communicating bi-directionally with the bus 102 via the bus interface 214, a transceiver 206 for receiving communications from the bus 102 via the bus interface 214, and a transceiver 208 for communicating bi-directionally with devices external to the vending machine in which the vending system 112 is used. The CPD 108 may also include, for example, a card reader, a display, a contactless (e.g., RFID) card reader and other devices (not shown). The transceivers 204 and 206 may each be a universal asynchronous receiver/transmitter ("UART"). The transceiver 208 may be a conventional wired or wireless device configured for communicating via a network, e.g., cellular, telephone, or global information network (Internet). Other suitable transceivers will be understood by one of skill in the art from the description herein.

The illustrated bus interface 214 includes a cashless payment interface 214*a* and a diagnostic collection interface 214*b*. In an exemplary embodiment, the cashless payment interface 214*a* is used by the processing unit 202*a* to provide cashless payment functionality for the vending machine and the diagnostic collection interface 214*b* is used to monitor the bus 102 for response communications sent by other peripheral devices.

Figure 3:
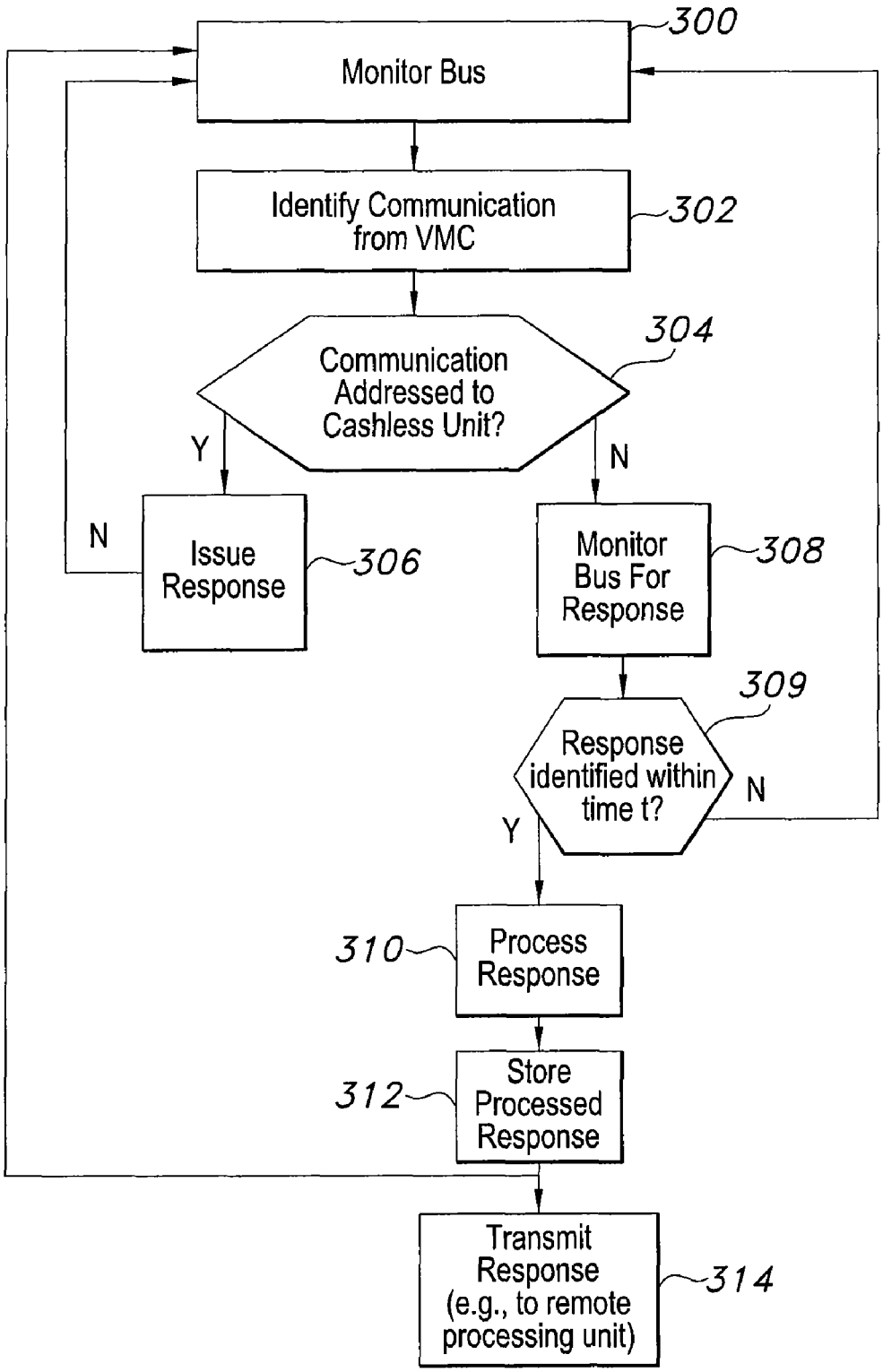
FIG. 3 is a flow chart of a method of communicating with a vending machine having a vending machine controller according to an exemplary embodiment of the present invention.

FIG. 3 is a flow chart of exemplary steps for performing the information gathering function. In an exemplary embodiment, the CPD 108*a* performs the information gathering function described with respect to FIG. 3.

In step 300, a vending bus is monitored. In an exemplary embodiment, the CPD 108*a* continuously monitors the bus 102 for communications (e.g., diagnostic information queries/responses) from/to the VMC 100. The bus 102 may be continuously monitored for all communications placed on the bus 102. More specifically, the cashless payment interface 214*a*, under control of the processor 210 within the processing unit 202*a*, may monitor the bus 102 for communications sent by the VMC 100 using the transceiver 204.

In step 302, a communication from the VMC 100 is identified. In an exemplary embodiment, the CPD 108*a* identifies the communication from the VMC 100. In an embodiment in which a MDB is used as the bus 102, the VMC 100 places all communications on the bus 102, and the communications are received by all peripheral devices connected to the bus 102.

Thus, when the VMC 100 places a communication on the bus 102, the CPD 108*a* receives it, thereby identifying the communication from the VMC 100. More specifically, when a communication is sent by the VMC 100, the cashless payment interface 214*a* may pass the communication via the transceiver 204 to the processing unit 202*a* for identification. When a MDB is used as the bus 102, the processing unit 202*a* may receive all communications placed by the VMC 100 on the bus 102 and then parse out the addressee of the communication.

In decision block 304, a determination is made as to whether the communication is addressed to the CPD 108*a*. In an exemplary embodiment, the processor 210 within the processing unit 202*a* determines whether the communication is addressed to the CPD 108*a*. The processing unit 202*a* may determine whether the communication is addressed to the CPD 108*a* by reading the address of the communication from the VMC 100. When a MDB is used as the bus 102, communications from the VMC 100 are addressed to the peripheral device from which the VMC 100 requires a response. Thus, by reading the address line, the processing unit 202*a* may determine whether the communication is addressed to the CPD 108*a* or to another peripheral device.

If the communication is addressed to the CPD 108*a*, in step 306, a response is issued. In an exemplary embodiment, the processing unit 202*a* issues a response to the VMC 100 via the UART 204, the cashless payment interface 214*a*, and the bus 102. The response may include information that the VMC 100 has requested.

If the communication is not addressed to the CPD 108*a*, in step 308, the bus is monitored to identify a response. In an exemplary embodiment, the processing unit 202*a* controls the diagnostic collection interface 214*b* to monitor the bus 102 for a response to the communication from another peripheral device using UART 206 (e.g., from a peripheral device that is not the CPD).

In decision block 309, whether a response is received within a defined time t is determined. In an exemplary embodiment, the CPD 108*a* identifies the response by monitoring the bus 102 for a response to the communication sent by a peripheral device, which is expected within a defined period of time t (e.g., 5 ms). In an embodiment in which the MDB is used as the bus 102, when the VMC 100 places a communication on the bus 102, the VMC 100 addresses the communication to a peripheral device from which it requires a response. Thus, when the CPD 108*a* receives the identified communication, it is able to determine from the address which peripheral device is expected to respond. If a response is not received within time t, the process returns to the monitoring step 300 so that further communications that the VMC 100 places on the bus 102 are not missed. If a response is received within time t, the process continues to step 310.

In step 310, the received response is processed. In an exemplary embodiment, the processing unit 202*a* performs the processing steps. The received response may indicate that the peripheral device is in an abnormal state (e.g., it is out of money, jammed, etc.). Here, the processing may simply include associating an identifier with the response. The identifier may relate to, for example, the peripheral device that sent the response and/or the time the response was received, or may be any arbitrary identifier. The response may, however, provide a more specific indication (e.g., there are 5 quarters left for dispensing from the coin acceptor/changer 104). Here, additional processing/analyzing of the response may be performed. For example, the number of quarters left for dispensing from the coin acceptor/changer 104 may be compared against a threshold number. If the number of coins left is less than or equal to the threshold number, an event is triggered. The event may be the generation of a processed/analyzed response indicating that service is needed to fill the coin acceptor/changer 104 with additional coins, for example.

The processing performed in step 310 may include analyzing the received response to determine a level of priority. For example, each response may be assigned a low, medium or high level of priority. By way of example, a response indicating that the number of coins remaining in the vending machine for providing change is low may be assigned a lower priority than a response indicating that the vending machine is completely empty of coins for providing change. As described in further detail below, the assigned priority level may be used to determine how quickly the problem is reported (e.g., how quickly the analyzed response is transmitted to a remote processing unit such as remote processing unit 702 in FIG. 7).

In step 312, the response is stored, which may be the received response or a processed/analyzed response based on the received response. In an exemplary embodiment, the processing unit 202*a* stores the response with the associated identifier in memory 212. When the received response provides the more specific indication, data corresponding to the processed/analyzed response may be stored in the memory 212 if the event is triggered along with an associated identifier. Here, when the event is not triggered, the processed response may not be stored because it does not indicate that any action needs to be taken with respect to the vending machine. For example, if the number of coins remaining in the coin acceptor/changer is greater than the threshold, the coin acceptor/changer 104 does not require additional coins. After the processed response is stored in step 312, processing returns to step 300 and may proceed to step 314.

In step 314, the response(s) is/are transmitted. In an exemplary embodiment, the transceiver 208 transmits the response(s) to an external device (e.g., a remote processing unit from which a user may collect the transmitted data within a relatively short period of time of its transmission and, accordingly, know shortly after the vending machine malfunctions to send someone out to fix or replenish the vending machine). The response(s) may be transmitted over, for example, a global information network (e.g., the Internet), intranet, satellite system, telephone system, or other suitable communication system. Transmitting step 314 may occur at different times after completion of storing step 312, and the different times may be customizable. By way of example, processed responses may be transmitted immediately after they are stored (e.g., responsive to storing the processed response or after a very short time period such as 5 ms). By way of another example, the processed responses may be scheduled for periodic/calendar-based transmittal (e.g., once every hour, day, week, etc.), scheduled for transmittal at set times of day (e.g., every day at 6 o'clock PM), or scheduled for interval transmittal (e.g., fixed time since last transmittal). As described above, some or all of the processed responses may be assigned priority levels during processing step 310. Here, the timing of the transmissions may depend on the assigned priority level. For example, high priority responses may be sent immediately and low priority responses may be sent daily.

Figure 4:
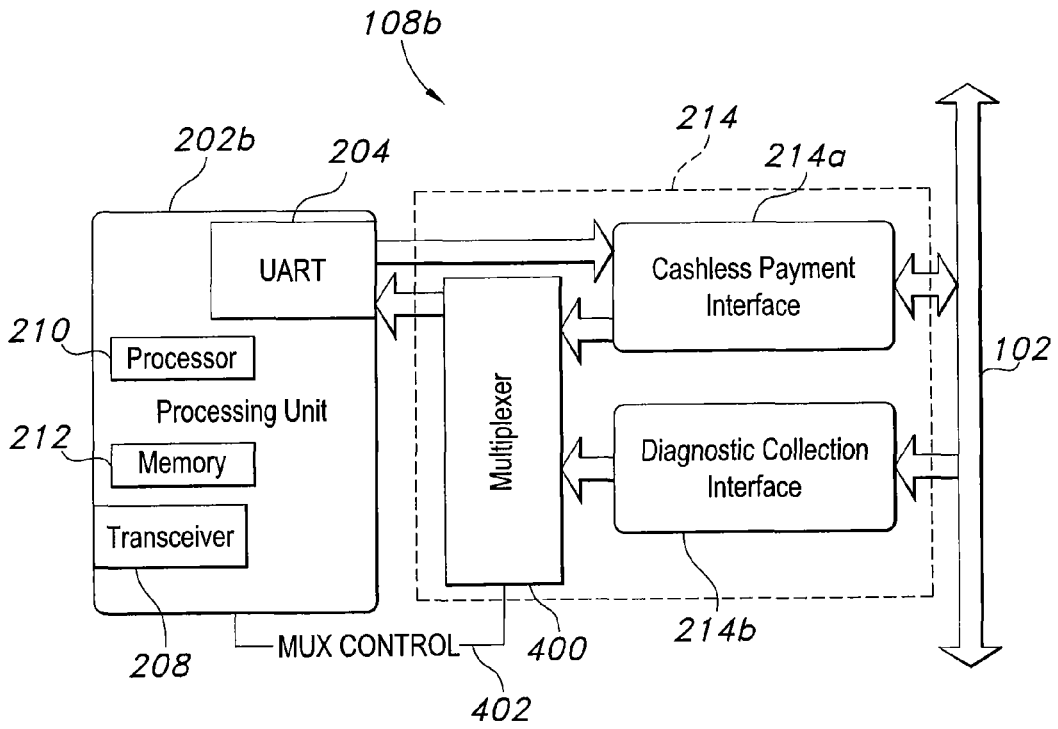
FIG. 4 is a block diagram of a cashless payment with diagnostics unit according to an exemplary embodiment of the present invention.

FIG. 4 is a block diagram of an alternative exemplary CPD 108*b*. The illustrated CPD 108*b* includes a processing unit 202*b* and a bus interface 214. The illustrated processing unit 202*b* includes the UART 204 and the transceiver 208. The illustrated bus interface 214 includes the cashless payment interface 214*a*, the diagnostic collection interface 214*b* and a multiplexer 400. The processing unit 202*b* controls the multiplexer 400 using at least a multiplexer control line 402. As shown in FIG. 4, the CPD 108*b* is similar to the CPD 108*a*, except the processing unit 202*b* uses only one UART (204), which is configured to transmit data to the cashless payment interface 214*a* and receive data from either the cashless payment interface 214*a* or the diagnostic collection interface 214*b* via the multiplexer 400. It will be understood that other UARTs (not shown) may be present for other uses.

Figure 5:
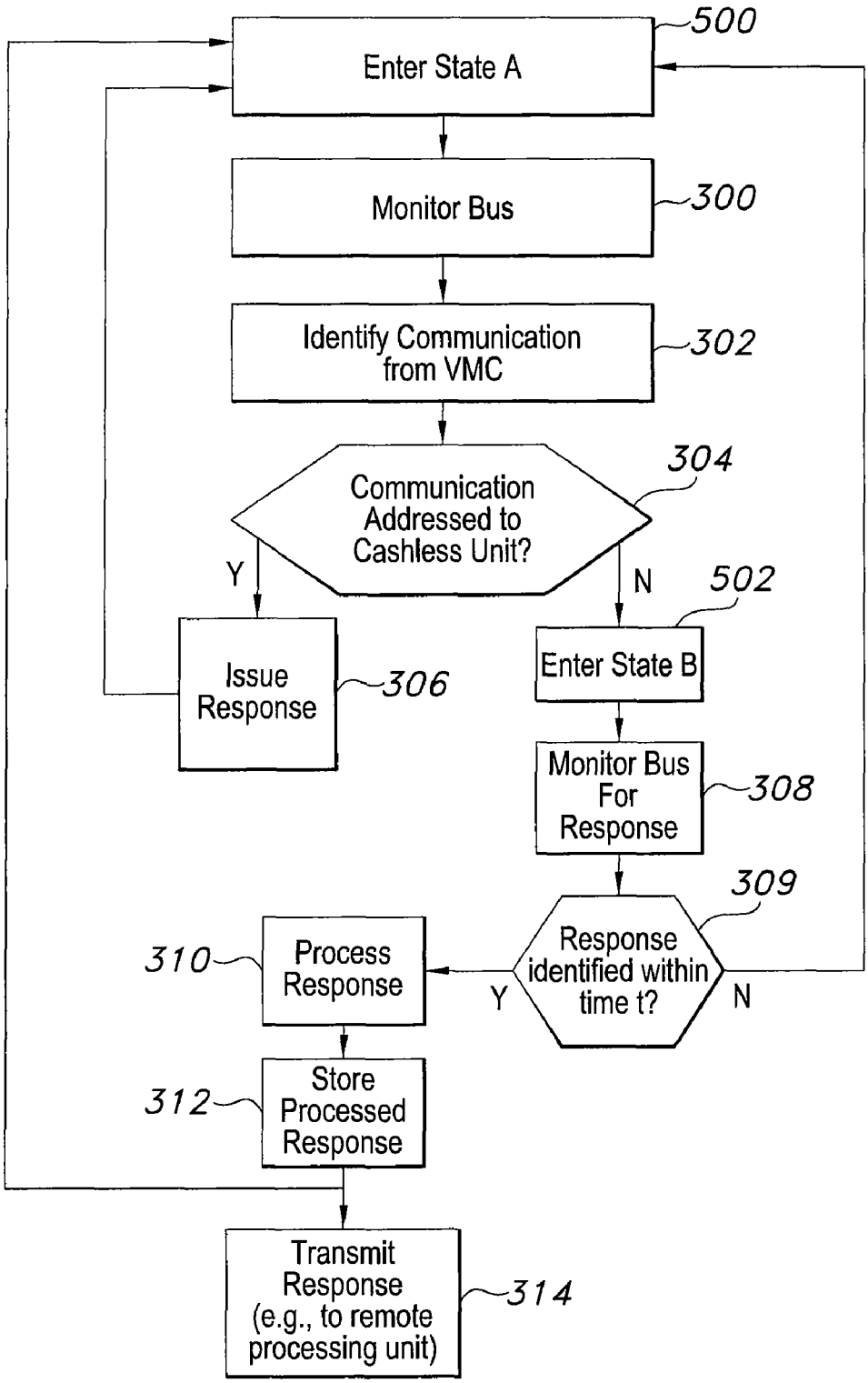
FIG. 5 is a flow chart of a method of communicating with a vending machine having a vending machine controller according to an exemplary embodiment of the present invention.

FIG. 5 is a flow chart of exemplary steps for performing the information gathering function using a multiplexer (e.g., multiplexor 400 in FIG. 4). In an exemplary embodiment, a state machine is implemented using either software (e.g., implemented by processor 210) or hardware included in the processing unit 202*b*, with the state machine governed in accordance with MDB protocol.

The illustrated flow chart includes two states of operation (i.e., state A, which is entered in step 500, and state B, which is entered in step 502). In state A, the multiplexor 400 is selected to listen to the bus 102 via cashless payment interface 214*a* for communications sent by the VMC 100 (step 300). If a valid message is sent by the VMC 100 while in state A, the message is received by the processing unit 202*b* via UART 204 (step 302). In decision block 304, the processing unit 202*b* determines whether the received message is addressed to the CPD 108*b*. If it is, a response is issued in step 306 and the state machine returns to state A. If not, the state machine enters state B in step 502. Steps 300, 302 and 306 and decision block 304 are the same as the corresponding steps/decision block in FIG. 3.

In state B (step 502), the multiplexor 400 is selected to listen to the bus 102 via diagnostic collection interface 214*b* for response communications from the peripheral devices (step 308). If a valid response message is sent by a peripheral device while in state B and within a defined time t (decision block 309), the message is received by the processing unit 202*b* via UART 204. The received message is then processed (step 310) and stored (e.g., in memory 212; step 312). After the processed response is stored, the state machine re-enters state A. The stored response may then be transmitted in step 314 as described above with respect to corresponding step 314 of FIG. 3. If it is determined that no response message is received within the defined time in decision block 309, a timeout may occur and state A may be re-entered. Steps 308, 310, 312 and 314 and decision block 309 are the same as the corresponding steps/decision block in FIG. 3.

In an exemplary embodiment, when a valid communication is received from the VMC 100 and the communication is addressed to the CPD 108*b*, the CPD 108*b* responds in accordance with the MDB specification and, in parallel, properly configures the state machine. Messages are received and stored for parsing and extraction of useful diagnostic information (e.g., using software at the remote processing unit of FIG. 7).

Figure 6:
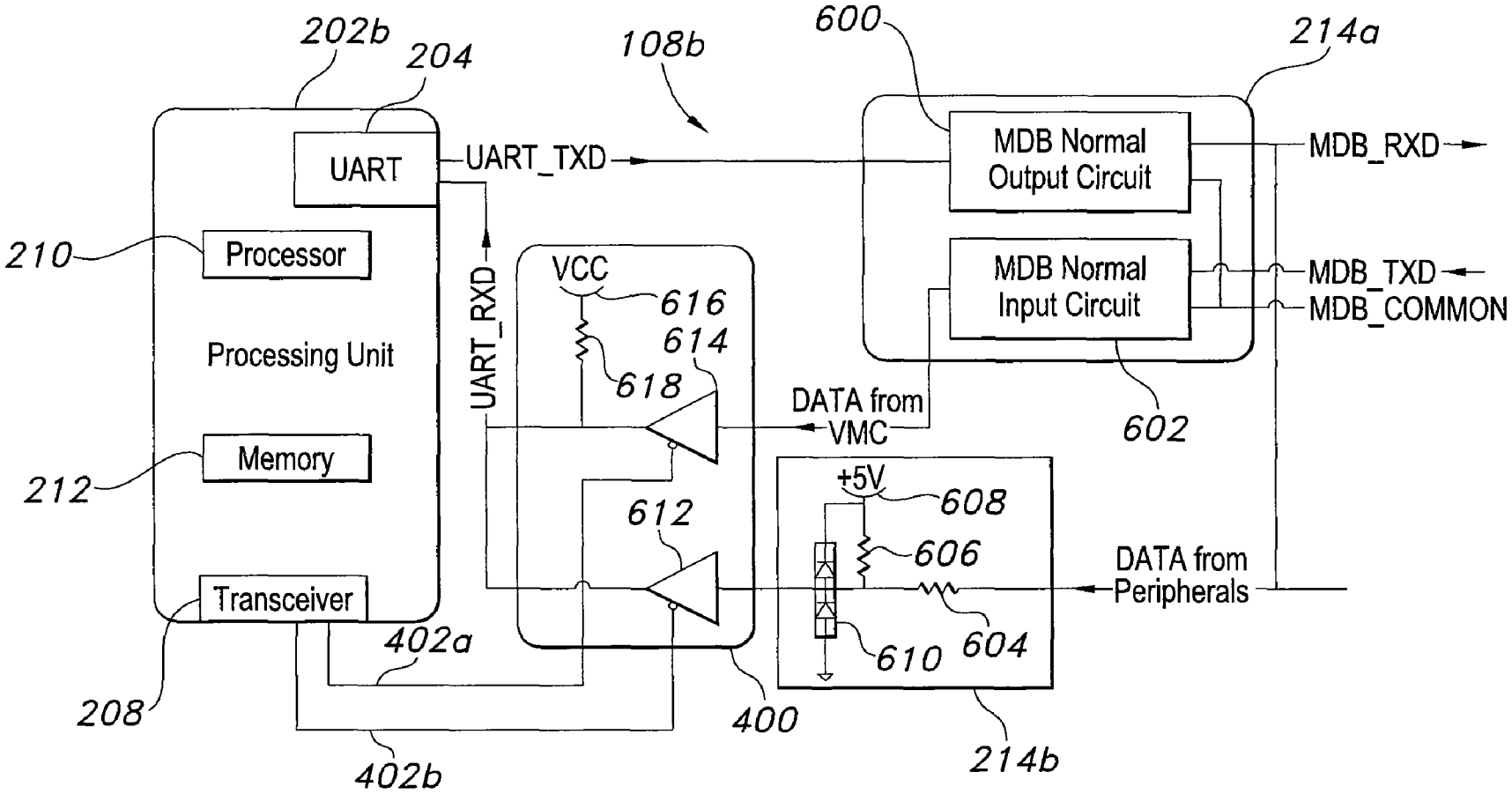
FIG. 6 is a circuit diagram of the cashless payment with diagnostics unit of FIG. 4 according to an exemplary embodiment of the present invention.

FIG. 6 is a circuit diagram showing exemplary circuitry for use with processing unit 202*b* (FIG. 4). The exemplary circuitry includes circuitry for MUX 400, cashless payment interface 214*a* and diagnostic collection interface 214*b*.

The illustrated circuitry for multiplexer 400 includes two logic integrated circuits ("ICs") 612 and 614. The illustrated ICs are 74LCX125 logic units. Other suitable logic units will be understood by one of skill in the art from the description herein. The IC 614 is coupled to a resistor 618 and a supply voltage VCC 616. The resistor 618 may be a 10K resistor. IC 614 is configured to receive data from the VMC 100 and IC 612 is configured to receive data from the other peripheral devices.

In an exemplary embodiment, the diagnostic collection interface 214*b* includes a dual diode 610, resistors 604 and 606, and power supply 608, as illustrated. The dual diode 610, which may be a BAV99 dual diode, protects the IC 612. The resistor 606, which may be a 470 K-ohm resistor, provides weak pull-up. The resistor 604, which may be a 47 K-ohm, resistor, isolates the load of the IC 612, the dual diode 610 and the resistor 606 from the bus 102. This circuitry allows the diagnostic collection interface 214*b* to receive and condition responses from the VMC placed on the bus 102.

As described above with respect to FIG. 4, processing unit 202*b* controls the multiplexer 400 to transfer either data from the VMC 100 or data from the other peripheral devices to the processing unit 202*b*. The illustrated processing unit 202*b* controls the MUX 400 to transfer either data from the VMC 100 or from the other peripheral devices by turning on one of the ICs 612 and 614 using MUX control line 402*a* or 402*b*, respectively. Thus, when data from the VMC 100 is to be transferred, the processing unit 202*b* may apply a voltage to IC 614 and when data from the peripherals is to be transferred the processing unit may apply a voltage to IC 612. In an exemplary embodiment, the applied voltage is a logic low voltage (e.g., 0V).

The illustrated cashless payment interface 214*a* includes a MDB normal output circuit 600 and a MDB normal input circuit 602. Exemplary MDB normal output circuits and MDB normal input circuits according to MDB protocol are well known in the art. The illustrated MDB normal output circuit 600 is configured to receive information from the UART 204. The illustrated MDB normal input circuit 602 is configured to transmit data to the IC 614.

Figure 7:
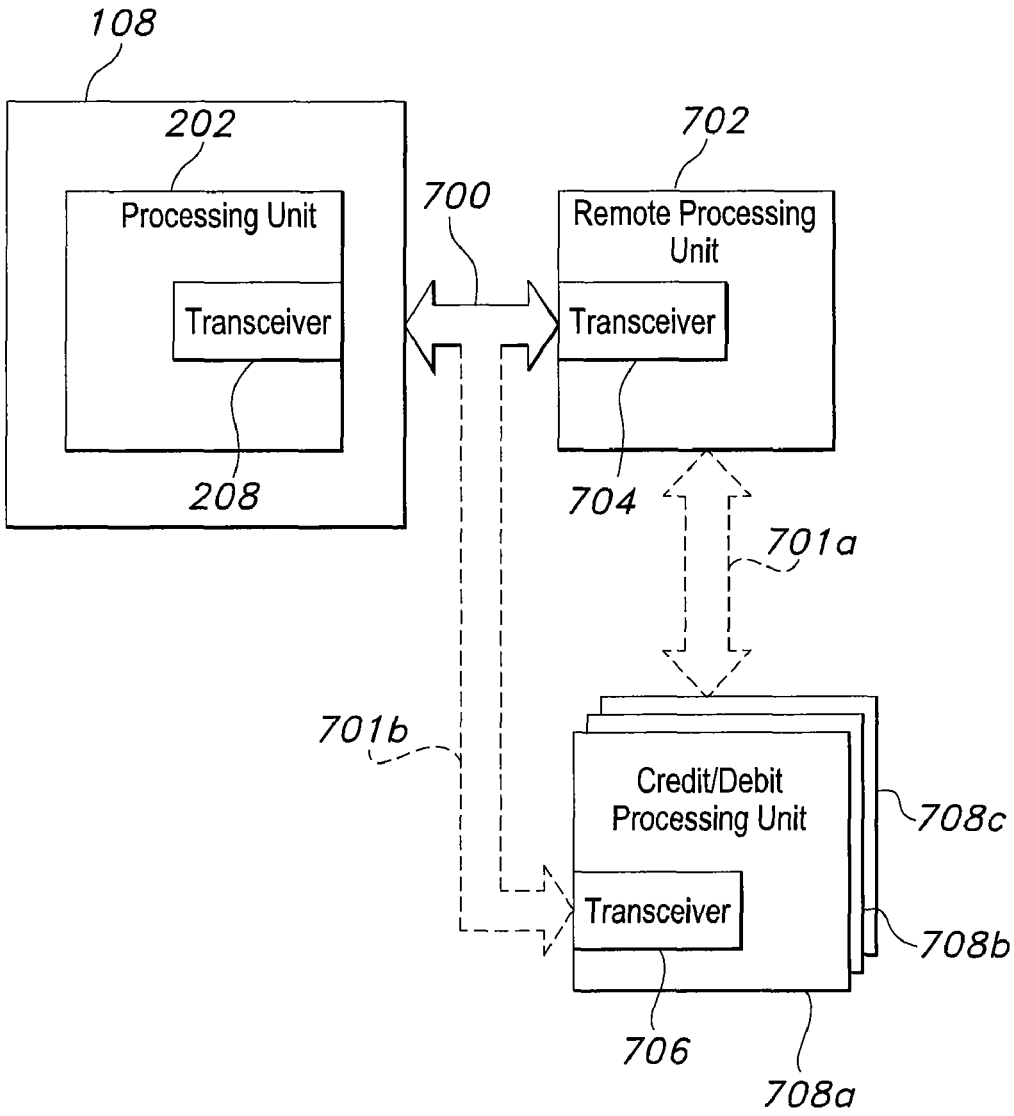
FIG. 7 is a block diagram showing communication between a cashless payment with diagnostics unit and a remote processing unit according to an exemplary embodiment of the present invention.

FIG. 7 is a block diagram of a communication system according to an exemplary embodiment. As described above, the processing unit 202 of the CPD 108 includes a transceiver 208 for communicating with remote devices external to the vending system 112. Such external devices may include, for example, a remote processing unit 702 and one or more credit/debit processing unit(s) 708*a*, 708*b*, and/or 708*c*, such as shown in FIG. 7. The remote processing unit 702 may be included in, for example, a computer at a vendor's office, at the vending machine manufacturer's office or at another location where it may be desirable for vending machine diagnostic information to be received, stored and/or analyzed. The credit/debit processing unit(s) 708 may be included, for example, in a computer(s) in a credit card company office, debit card company office, bank, or office of other agencies offering credit/debit. The remote processing unit 702 and the credit/debit processing unit(s) 708 may include transceivers 704 and 706, respectively.

In FIG. 7, the arrows represent a communication network 700 and optional communication networks 701*a* and *b*. Communication network 700 permits at least unidirectional communication between the processing unit 202 and the remote processing unit 702. Optional communication network 701*a* permits at least unidirectional communication between the processing unit 202 and the remote processing unit 702 and/or between the remote processing unit 702 and the credit/debit processing unit(s) 708. The network may include, for example, an intranet, a satellite system, a telephone system, a global information network (e.g., the Internet) or any other suitable communication system.

In an exemplary embodiment, all communication with the credit/debit processing unit 708 occurs via remote processing unit 702, in which case communication network 701*b* may be omitted. In such an embodiment, to establish communication with the credit/debit processing unit 708, the CPD 108 first sends the communication to the remote processing unit 702. The remote processing unit 702 may perform processing on the communication (e.g., combining it with other communications destined for the credit/debit processing unit 708). Then, with or without processing, the remote processing unit 702 transmits the communication to the credit/debit processing unit 708. In an alternative exemplary embodiment, the CPD 108 may transmit communications directly to the credit/debit unit 708, thereby bypassing the intermediary remote processing unit 702.

During the cashless vending operation of the CPD 108, when the CPD 108 receives a request from a user to pay for an item using credit/debit (e.g., by inserting a credit/debit card into the card reader (not shown) of the CPD), the transceiver 208 may transmit a request to the appropriate credit/debit processing unit 708 to authorize a credit/debit amount. As described above, the request may be sent either through the remote processing unit 702, which acts as an intermediary, or may be sent directly to the appropriate credit/debit processing unit 708. Upon receipt of the request by the appropriate credit/debit processing unit 708 via the transceiver 706, the transceiver 706 may transmit a response to the processing unit 202 either approving or denying the authorization request. Again, the processing unit 708 may transmit the response either indirectly through the remote processing unit 702 or directly to the credit/debit processing unit 708.

During the information gathering function of the CPD 108, the CPD 108 may upload the stored data to the remote processing unit 702. The uploading may occur, for example, at different times as described above with respect to step 314 in FIG. 3. To upload the data, the processing unit 202 may simply transmit the data using the transceiver 208 to the remote processing unit 702, which receives the data via the transceiver 704 and stores it in a memory (not shown). Thus, the vending system 112 may use the transceiver already included in the CPD 108 to transmit diagnostics data to a remote processing unit. And the vending system 112 uses capabilities of the vending system 112 to carry out multiple functions, thereby providing an efficient alternative to using a DEX interface to gather data from a vending machine including the vending system 112.

In an exemplary embodiment, the information gathering function includes gathering diagnostic information from the other peripheral devices. Such information may include, for example, whether the coin acceptor/changer unit 104 or the bill validator/acceptor unit 106 is empty or full of currency and whether other peripheral device(s) are operating properly (e.g., whether there is a bill acceptor jam). The ability to efficiently transfer diagnostic information to an external device facilitates inexpensive and relatively easy review of the information, thus enabling more immediate attention to diagnostic data that requires a response.

In another exemplary embodiment, the information gathering function includes gathering diagnostic information from vending machine (VM) sensors other than "other peripheral devices." Here, the CPD 108 may gather diagnostic information such as temperature readings from VM temperature sensor(s) 114 (e.g., a thermistor(s)) located at one or more locations within the vending machine, interruptions in power being supplied to the vending machine from external VM power failure sensor(s) 116 (e.g., a power relay(s)) and whether the vending machine's door is open from VM open door sensors 118 (e.g., a proximity switch(es)). Use of the CPD 108 with temperature sensors, power failure sensors and open door sensors, for example, may quickly and remotely provide important information to an owner/operator of the vending machine. Such information may include whether the temperature in the device has dropped below desirable or safe operating levels, whether power to the device has been compromised and whether a reach-in vending machine's door has been left open, thereby enabling a quick response to emergency conditions to, for example, remove spoiled product from the machine or to fix the vending machine before the product spoils. This may be especially useful in applications such as vending machines that dispense or store frozen or spoilable food product.

The CPD 108 may also be configured to transmit payment requests to the remote processing unit 702. This may be useful, for example, so that one entity may compile and send out multiple requests to the same credit/debit company in one bulk transaction.

The information gathering functions described in relation to FIGS. 3, 5, and 7 may be used to determine when an alert or event should be generated relating to the vending machine. It may be desirable to generate alerts to indicate when the vending machine has malfunctioned or requires service. Exemplary alerts may include, for example: low coins; vendor out of service; no communication from the vending machine for a predefined period (e.g., 24 hours) alert; no sales for a predefined period (e.g., 24 hours) alert; and no sales of a specific product for 24 hours. These alerts may be generated at a vending system (e.g., by CPD 108) or remotely (e.g., by remote processing unit 702). It may be desirable to generate alerts at the vending system to limit the amount of data communicated to the remote processing unit 702. Exemplary methods for generating specific alerts will now be described herein with respect to the vending system of FIG. 1 and the communications system of FIG. 7. Alternative vending and communications systems suitable for implementing these methods will be understood by one of ordinary skill in the art from the description herein.

Figure 8:
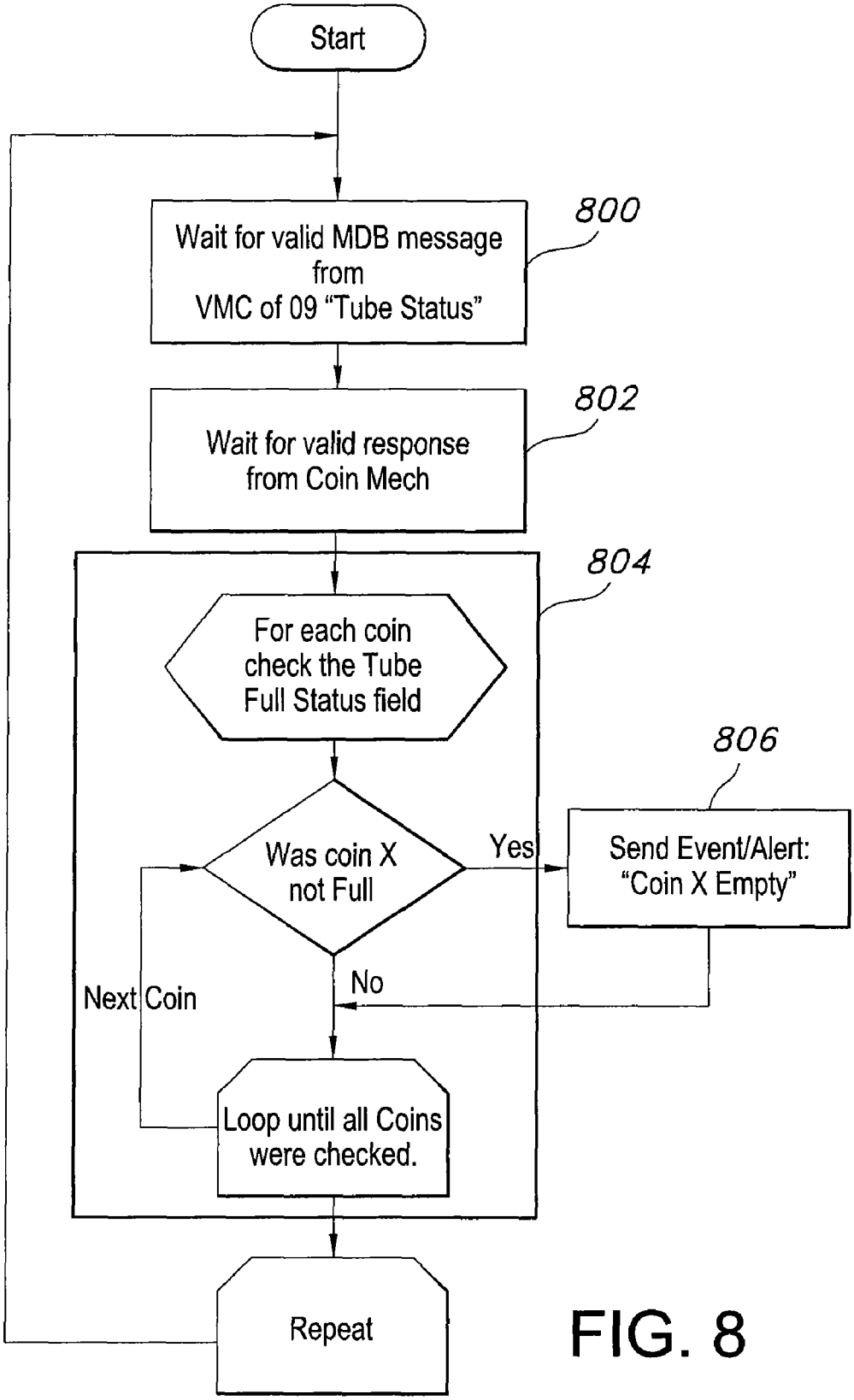
FIG. 8 is a flow chart of a method for generating a low coin alert for a vending machine according to an exemplary embodiment of the present invention.

FIG. 8 is a flow chart of exemplary steps for generating an alert indicating that the vending machine coins, e.g., for dispensing change, are low. In an exemplary embodiment, CPD 108 and/or remote processing unit 702 generate the alert described with respect to FIG. 8.

In step 800, the vending bus is monitored to identify data requesting the status of the coin tubes within the vending machine. In an exemplary embodiment, the CPD 108 continuously monitors bus 102 for a "Tube Status" message from VMC 100, as described in steps 300-304. Bus 102 may be a MDB, as described above. More specifically, the CPD 108 monitors bus 102 for communications, as in step 300. When a communication is received, CPD 108 identifies whether the communication is from VMC 100, as in step 302. When CPD 108 determines that the communication is from VMC 100, CPD 108 determines whether the communication is to coin acceptor/changer 104, as in step 304. When CPD 108 determines that the communication is to coin acceptor/changer 104, CPD 108 determines whether the message is requesting the "Tube Status" of the coin acceptor/changer 104.

In step 802, the vending bus is monitored to identify a response to the identified request for the status of the coin tubes in step 800. In an exemplary embodiment, the CPD 108 continuously monitors bus 102 for a response to the "Tube Status" message from the coin acceptor/changer 104, as described in steps 308 and 309. More specifically, the CPD 108 monitors bus 102 for a response to the "Tube Status" message, as in step 308. CPD 108 also determines whether a response to the "Tube Status" message is received within a defined time t, as in step 309.

In step 804, the response identified in step 802 is processed. A conventional response to a "Tube Status" message may include a field indicating whether each coin tube is full, e.g., a "Tube Full Status" field. In an exemplary embodiment, the "Tube Full Status" field of the response is checked for each coin. The received response may be processed by processing unit 202, as described in step 310. Alternatively, the received response may be stored and transmitted to remote processing unit 702, as described in steps 312-314. In this case, the received response may be processed by remote processing unit 702.

More specifically, the response to the "Tube Status" message includes a "Tube Full Status" field for each type of coin in coin acceptor/changer 104. The processor checks the "Tube Full Status" field for each type of coin to determine whether or not the corresponding tube is full. The "Tube Full Status" field may include a bit corresponding to each coin tube. If the tube for a coin type is not full, as indicated by the bit corresponding to the coin tube not being active, the method proceeds to step 806. If the tube for a coin type is full, as indicated by the bit corresponding to the coin tube being active, the processor proceeds to check the "Tube Full Status" field for the next coin type. The processor repeats this step until the "Tube Full Status" field is checked for each coin in the coin acceptor/changer 104. Then, the method returns to step 800.

In step 806, a low coin alert is generated. In an exemplary embodiment, the unit that processes the received response (either processing unit 202 or remote processing unit 702) generates a low coin alert. The low coin alert may indicate that a coin tube of coin acceptor/changer 104 is not full. The alert may further indicate the corresponding coin type of the unfull tube.

Additionally, the processor may send the low coin alert to a party responsible for servicing the vending machine. The processor, however, may be configured not to send out a low coin alert every time the alert is generated. For example, the processor may be configured to only send an alert periodically, e.g., no more than once per day. After the alert is generated and/or sent, the method proceeds back to step 804 if there are any coin tubes remaining to be checked. Otherwise, the method returns to step 800.

Figure 9:
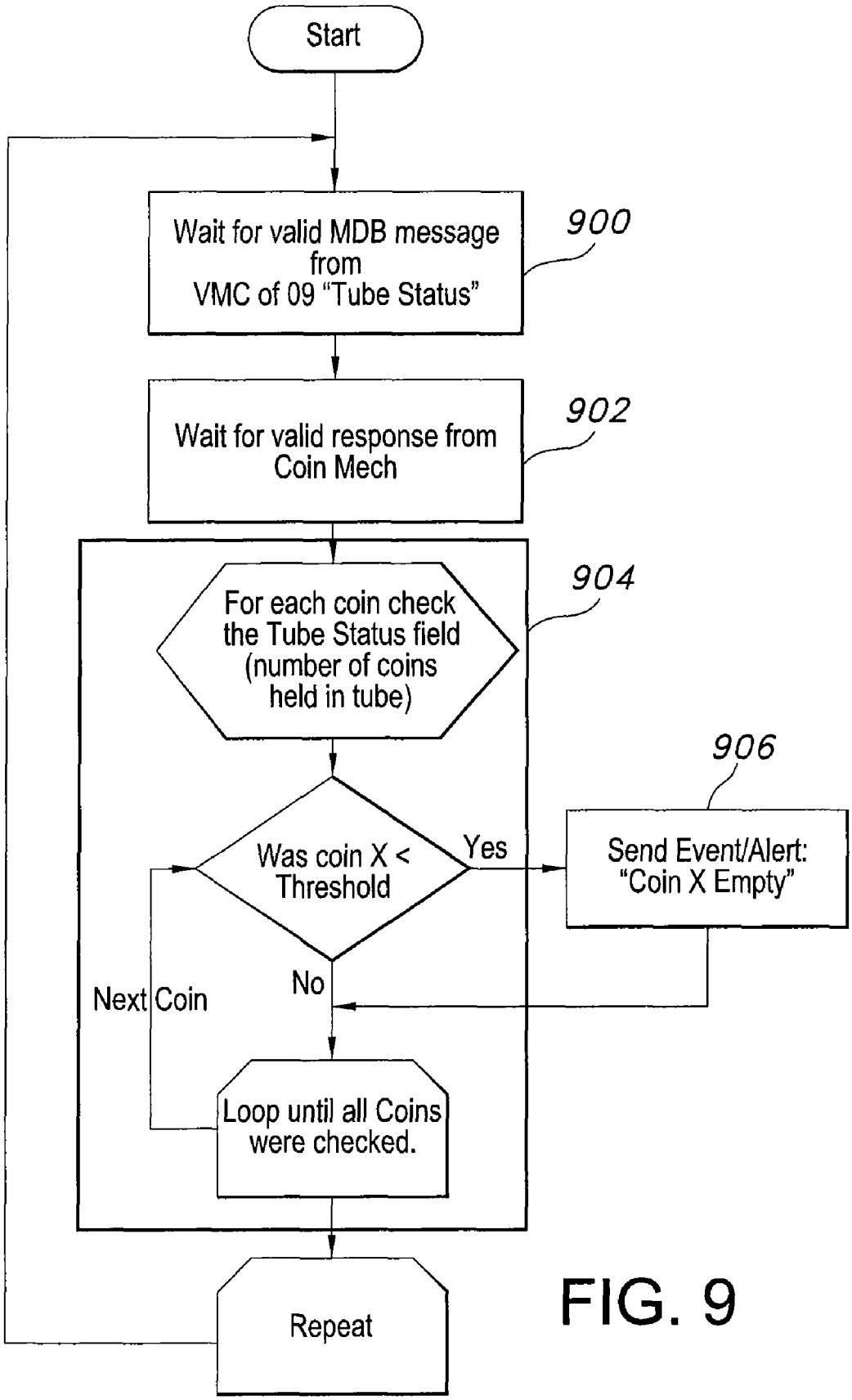
FIG. 9 is a flow chart of another method for generating a low coin alert for a vending machine according to an exemplary embodiment of the present invention.

FIG. 9 is a flow chart of other exemplary steps for an alert indicating vending machine coins are low. In an exemplary embodiment, CPD 108 and/or remote processing unit 702 generate the alert described with respect to FIG. 9.

In step 900, the vending bus is monitored to identify data requesting the status of the coin tubes within the vending machine. In an exemplary embodiment, the CPD 108 continuously monitors bus 102 for a "Tube Status" message from VMC 100, as described in step 800.

In step 902, the vending bus is monitored to identify a response to the identified request for the status of the coin tubes in step 900. In an exemplary embodiment, the CPD 108 continuously monitors bus 102 for a response to the "Tube Status" message from the coin acceptor/changer 104, as described in step 802.

In step 904, the response identified in step 802 is processed. A conventional response to a "Tube Status" message may include a field indicating how many coins are in each tube, e.g., a "Tube Status" field. In an exemplary embodiment, the "Tube Status" field of the response is checked for each coin. The received response may be processed by processing unit 202 or by remote processing unit 702, as described in step 804.

More specifically, the response to the "Tube Status" message includes a "Tube Status" field, which indicates for each type of coin the number of coins held in the corresponding tube in coin acceptor/changer 104. The processor checks the "Tube Status" field for each type of coin to determine how many coins are held in the tube. If the number of coins in the tube is below a predetermined threshold number, the method process to step 906. If the number of coins in the tube is greater than or equal to the threshold number, the processor proceeds to check the "Tube Status" field for the next coin type. The processor repeats this step until the "Tube Status" field is checked for each coin in the coin acceptor/changer 104. Then, the method returns to step 900.

In step 906, a low coin alert is generated. In an exemplary embodiment, the unit that processes the received response generates a low coin alert, as described in step 806. The processor may also send the low coin alert to a party responsible for servicing the vending machine.

Figure 10:
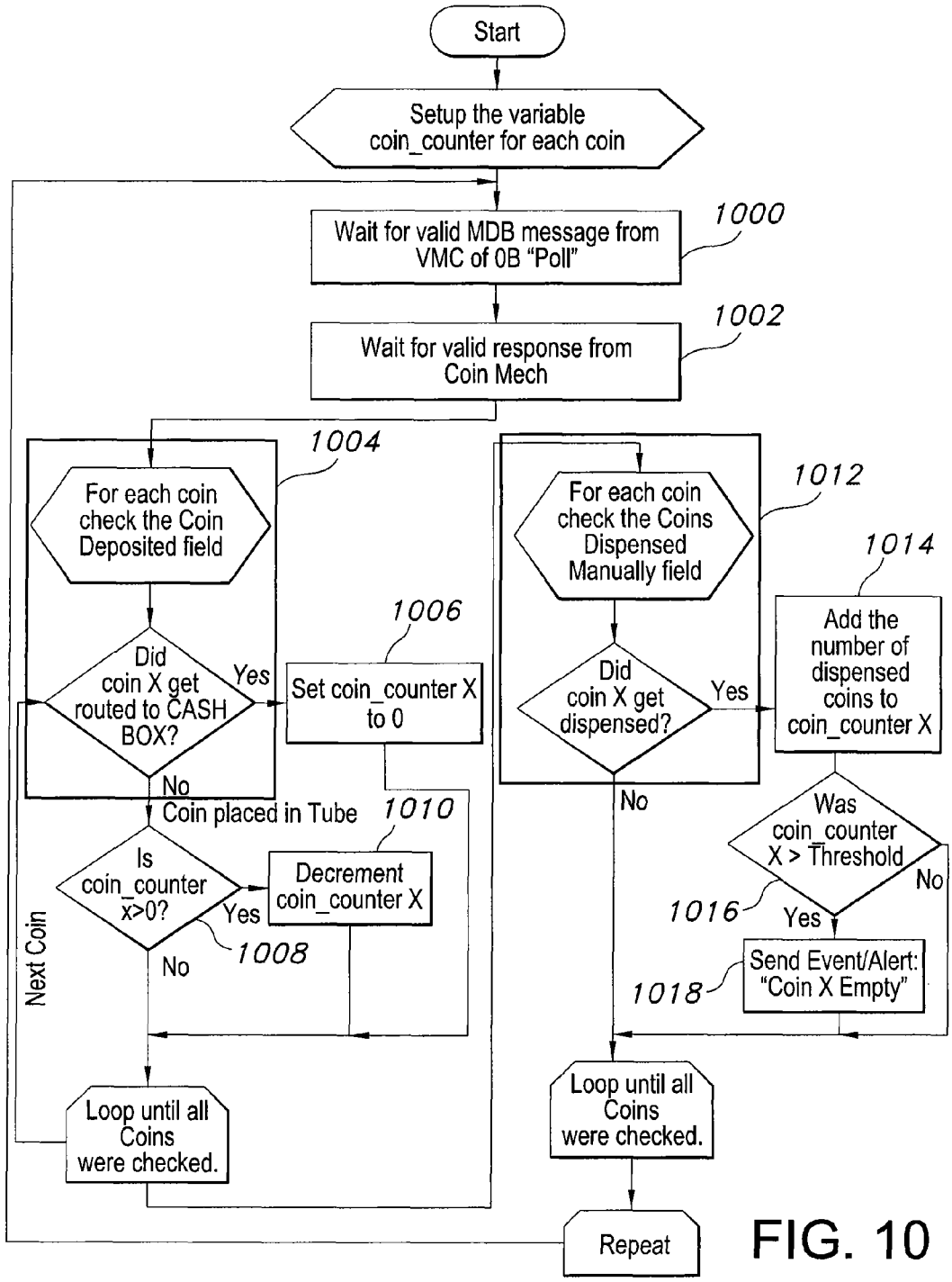
FIG. 10 is a flow chart of yet another method for generating a low coin alert for a vending machine according to an exemplary embodiment of the present invention.

FIG. 10 is a flow chart of exemplary steps for generating an alert indicating that vending machine coins are low. In an exemplary embodiment, CPD 108 and/or remote processing unit 702 generate the alert described with respect to FIG. 10.

In step 1000, the vending bus is monitored to identify data requesting information on the activity of a peripheral device in the vending machine. In an exemplary embodiment, the CPD 108 continuously monitors bus 102 for a "Poll" message from VMC 100, as described in steps 300-304. Bus 102 may be a MDB, as described above. More specifically, the CPD 108 monitors bus 102 for communications, as in step 300. When a communication is received, CPD 108 identifies whether the communication is from VMC 100, as in step 302. When CPD 108 determines that the communication is from VMC 100, CPD 108 determines whether the communication is to coin acceptor/changer 104, as in step 304. When CPD 108 determines that the communication is to coin acceptor/changer 104, CPD 108 determines whether the message is a "Poll" message to coin acceptor/changer 104.

In step 1002, the vending bus is monitored to identify a response to the identified request for information in step 1000. In an exemplary embodiment, the CPD 108 continuously monitors bus 102 for a response to the "Poll" message from the coin acceptor/changer 104, as described in steps 308 and 309. More specifically, the CPD 108 monitors bus 102 for a response to the "Poll" message, as in step 308. CPD 108 also determines whether a response to the "Poll" message is received within a defined time t, as in step 309.

In step 1004, the response identified in step 1002 is processed. A conventional response to a "Poll" message may include a field indicating how many coins have been deposited, e.g., a "Coin Deposited" field. In an exemplary embodiment, the "Coin Deposited" field of the response is checked for each coin. The received response may be processed by processing unit 202, as described in step 310. Alternatively, the received response may be stored and transmitted to remote processing unit 702, as described in steps 312-314. In this case, the received response may be processed by remote processing unit 702.

More specifically, the response to the "Poll" message includes a "Coin Deposited" field for each type of coin in coin acceptor/changer 104. The processor checks the "Coin Deposited" field for each type of coin to determine whether or not a deposited coin of that type was routed to the cash box, instead of the corresponding tube. If a deposited coin for the coin type was routed to the cash box, the method process to step 1006. If a deposited coin for the coin type was not routed to the cash box, i.e., was routed to the coin tube, the method proceeds to step 1008. After completing the ensuing steps, the processor repeats step 1004 until the "Coin Deposited" field is checked for each coin in the coin acceptor/changer 104.

Then, the method proceeds to step 1012.

In step 1006, a coin counter is set to zero. In an exemplary embodiment, the unit that processes the received response (either processing unit 202 or remote processing unit 702) maintains a coin counter for each type of coin in coin acceptor/changer 104. When it is indicated that a deposited coin for a particular coin type is routed to the cash box, instead of the tube, the processor sets the coin counter for that coin type to zero. After the coin counter is set to zero, the method proceeds back to step 1004 if there are any coin types remaining to be checked. Otherwise, the method proceeds to step 1012.

In step 1008, a coin counter is checked. In an exemplary embodiment, the unit that processes the received response (either processing unit 202 or remote processing unit 702) maintains a coin counter for each type of coin in coin acceptor/changer 104. When it is indicated that a deposited coin for a particular coin type is routed to the coin tube, the processor checks the value of the coin counter for that coin type. If the coin counter for that coin type is greater than zero, the method proceeds to step 1010. If the coin counter for that coin type is zero, the method proceeds back to step 1004 if there are any other coin types remaining to be checked. Otherwise, the method proceeds to step 1012.

In step 1010, the number of coins routed to the coin tube is subtracted from the coin counter. In an exemplary embodiment, when it is indicated that a particular type of coin is routed to the coin tube, and the coin counter for that coin tube is greater than zero, the processor subtracts the number of received coins from the coin counter for that coin type. After the coin counter is so decremented, the method proceeds to step 1012.

In step 1012, the response identified in step 1002 is further processed. A conventional response to a "Poll" message may also include a field indicating how many coins have been dispensed, e.g., a "Coins Dispensed Manually" field. In an exemplary embodiment, the "Coins Dispensed Manually" field of the response to the "Poll" message is checked for each coin. The received response may be processed by processing unit 202 or by remote processing unit 702, as described in step 1004.

More specifically, the response to the "Poll" message includes a field for each type of coin in coin acceptor/changer 104 indicating whether a coin was dispensed. In an exemplary embodiment, this field may be a "Coins Dispensed Manually" field. The processor checks the "Coins Dispensed Manually" field for each type of coin to determine whether or not a coin of that type was dispensed. If a coin for the coin type was dispensed, the method process to step 1014. If not, the processor proceeds to check the "Coins Dispensed Manually" field for the next coin type. The processor repeats this step until the "Coins Dispensed Manually" field is checked for each coin in the coin acceptor/changer 104. Then, the method returns to step 1000.

In step 1014, the number of coins dispensed is added to the coin counter. In an exemplary embodiment, as described above, the unit that processes the received response (either processing unit 202 or remote processing unit 702) maintains a coin counter for each type of coin in coin acceptor/changer 104. When it is indicated that a particular type of coin is dispensed, the processor adds the number of dispensed coins to the coin counter for that coin type. After the coin counter is so incremented, the method proceeds to step 1016.

In step 1016, the coin counter is compared with a predetermined threshold. In an exemplary embodiment, the unit that maintains the coin counter for each type of coin compares the coin counter to a predetermined threshold. If the coin counter is above the predetermined threshold for the particular type of coin, the method proceeds to step 1018. If the coin counter is equal to or below the predetermined threshold, the method proceeds back to step 1008 if there are any coin types remaining to be checked. Otherwise, the method returns to step 1000.

In step 1018, a low coin alert is generated. In an exemplary embodiment, the unit that processes the received response generates a low coin alert, as described in step 806. The processor may also send the low coin alert to a party responsible for servicing the vending machine.

Figure 11:
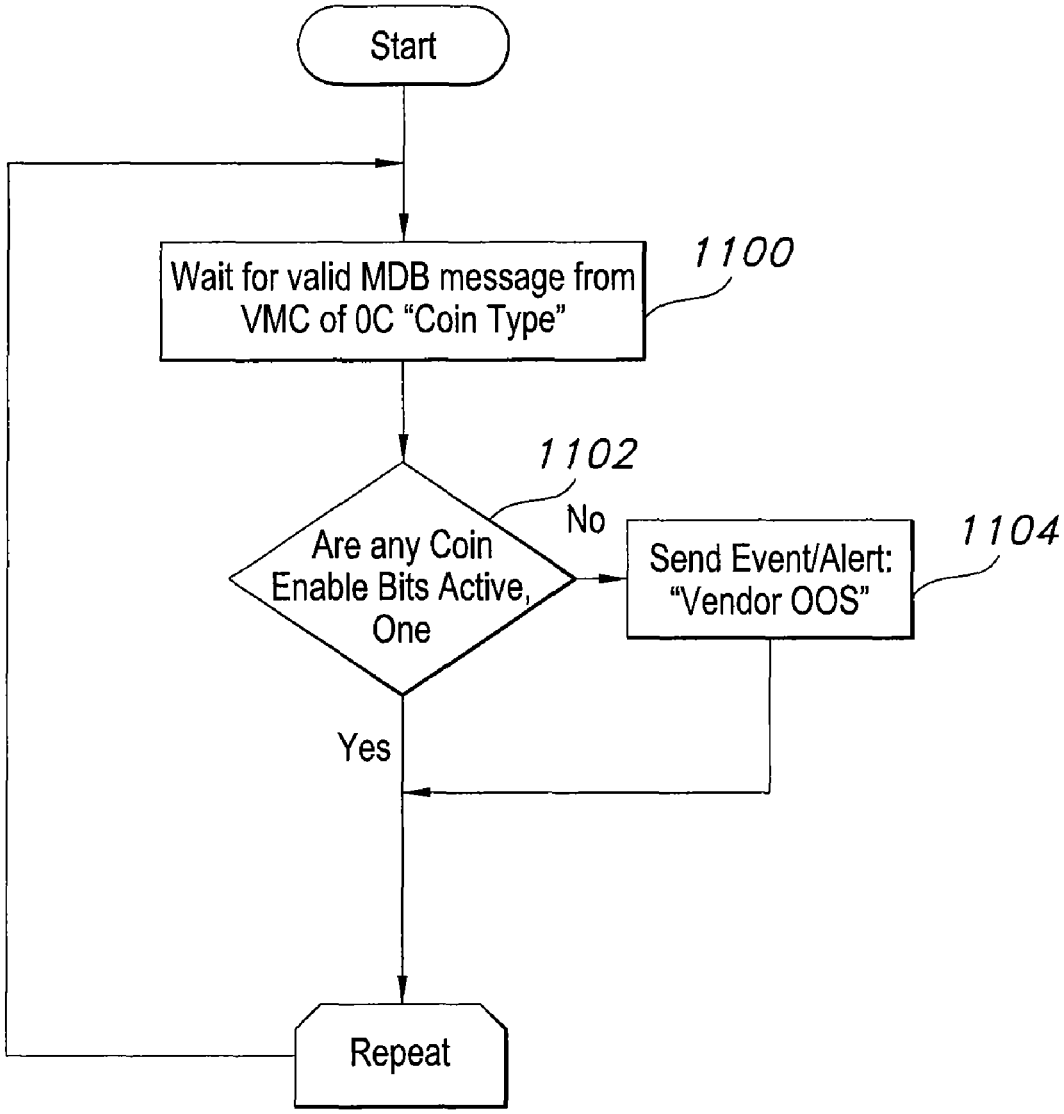
FIG. 11 is a flow chart of a method for generating a vendor out of service alert for a vending machine according to an exemplary embodiment of the present invention.

FIG. 11 is a flow chart of exemplary steps for generating an alert indicating that a vending machine is out of service, e.g., a vendor out of service alert. In an exemplary embodiment, CPD 108 and/or remote processing unit 702 generate the alert described with respect to FIG. 11.

In step 1100, the vending bus is monitored to identify data indicating coin types accepted and dispensed by the vending machine. In an exemplary embodiment, the CPD 108 continuously monitors bus 102 for a "Coin Type" message from VMC 100, as described in steps 300-304. A "Coin Type" message may include information to coin acceptor/changer 104 on which coin types are accepted and which coin types are dispensed. Bus 102 may be a MDB, as described above. More specifically, the CPD 108 monitors bus 102 for communications, as in step 300. When a communication is received, CPD 108 identifies whether the communication is from VMC 100, as in step 302. When CPD 108 determines that the communication is from VMC 100, CPD 108 determines whether the message is a "Coin Type" message.

In step 1102, the data identified in step 1100 is processed. A conventional "Coin Type" message may include a plurality of bits indicating for each coin type, whether that coin is accepted by the coin acceptor/changer 104, e.g., "Coin Enable" bits. In an exemplary embodiment, the "Coin Enable" bits of the "Coin Type" message are checked. The received response may be processed by processing unit 202, as described in step 310. Alternatively, the received response may be stored and transmitted to remote processing unit 702, as described in steps 312-314. In this case, the received response may be processed by remote processing unit 702.

More specifically, the response to the "Coin Type" message includes a number of "Coin Enable" bits. The processor checks the "Coin Enable" bits to determine whether or not any of the bits are active (i.e., set to one), indicating that the coin type is accepted. If any "Coin Enable" bit is active, the method returns to step 1100. If all of the "Coin Enable" bits are not active, the method proceeds to step 1104.

In step 1104, a vendor out of service alert is generated. In an exemplary embodiment, the unit that processes the received response (either processing unit 202 or remote processing unit 702) generates a vendor out of service alert. Additionally, the processor may send the vendor out of service alert to a party responsible for servicing the vending machine. The processor, however, may be configured not to send out the alert every time the alert is generated. The processor may be configured to only send an alert periodically, e.g., no more than once per day. After the alert is generated and/or sent, the method returns to step 800.

Figure 12:
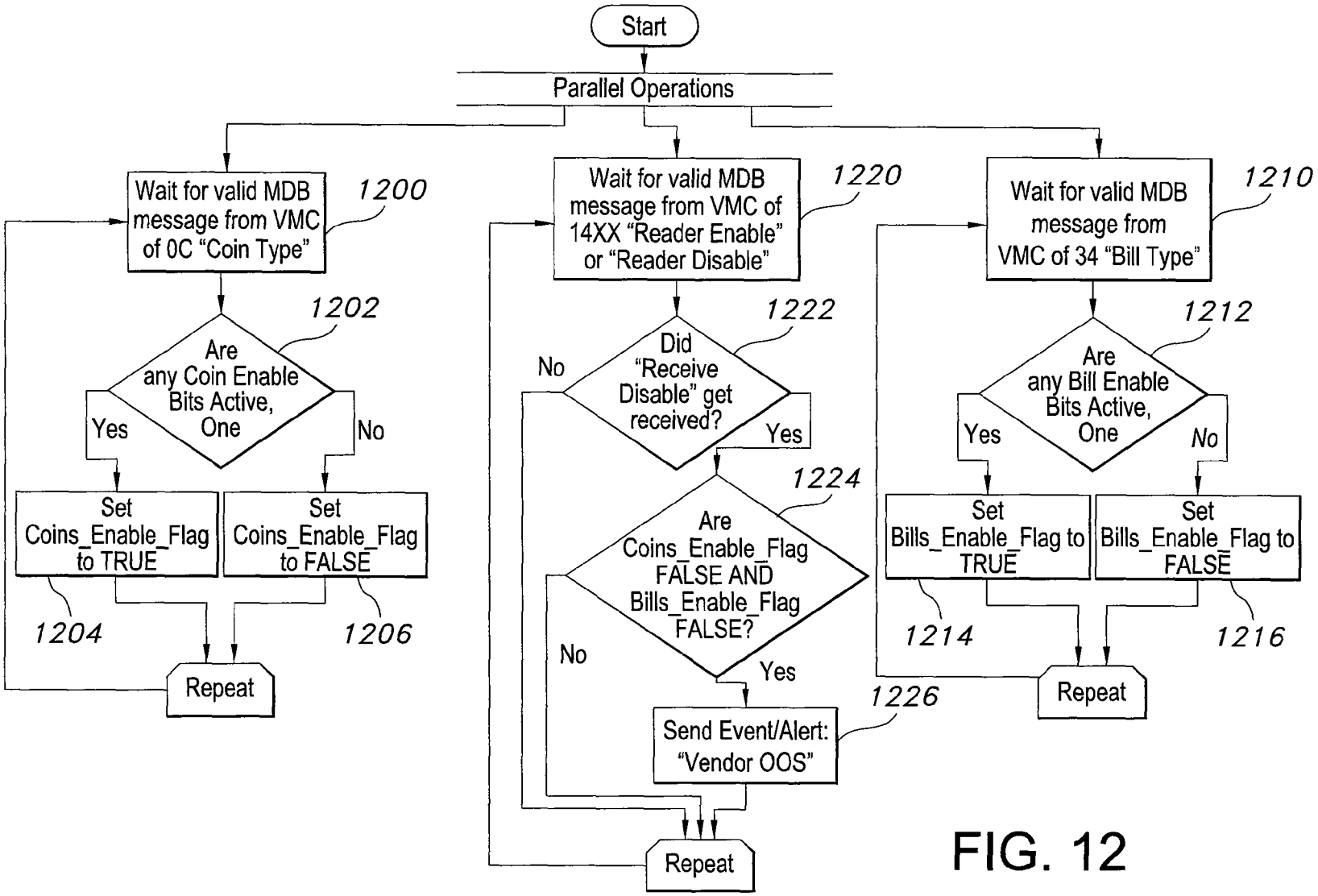
FIG. 12 is a flow chart of another method for generating a vendor out of service alert for a vending machine according to an exemplary embodiment of the present invention.

FIG. 12 is a flow chart of alternative exemplary steps for generating an alert indicating a vending machine is out of service, e.g., a vendor out of service alert. The method of FIG. 12 includes three sub-methods, which may be performed simultaneously or in sequence, as described below. In an exemplary embodiment, CPD 108 and/or remote processing unit 702 generate the alert described with respect to FIG. 12.

The first sub-method involves steps 1200-1206. In step 1200, the vending bus is monitored to identify data indicating coin types accepted and dispensed by the vending machine. In an exemplary embodiment, the CPD 108 continuously monitors bus 102 for a "Coin Type" message from VMC 100, as described in step 1100.

In step 1202, the data identified in step 1200 is processed. A conventional "Coin Type" message may in include a plurality of bits indicating for each coin type, whether that coin is accepted by the coin acceptor/changer 104, e.g., "Coin Enable" bits. In an exemplary embodiment, processing unit 202 or remote processing unit 702 checks the "Coin Enable" bits of the "Coin Type" message, as described in step 1102. If any of the "Coin Enable" bits is active, the sub-method proceeds to step 1204. If not, the sub-method proceeds to step 1206.

In step 1204, a first flag is activated. Conversely, in step 1206, the first flag is deactivated. In an exemplary embodiment, processing unit 202 or remote processing unit 702 maintains a "Coins Enable Flag" in a memory (e.g., memory 212). When the processor determines that any of the "Coin Enable" bits is active, the processor sets the value of the "Coins Enable Flag" to true. Conversely, when the processor determines that none of the "Coin Enable" bits are active, the processor sets the value of the "Coins Enable Flag" to false. The first sub-method then proceeds back to step 1200.

The second sub-method involves steps 1210-1216. In step 1210, the vending bus is monitored to identify data indicating bill types accepted by the vending machine. In an exemplary embodiment, the CPD 108 continuously monitors bus 102 for a "Bill Type" message from VMC 100, as described similarly in step 1100. A "Bill Type" message may include information to bill validator/acceptor 106 on which bill types are accepted.

In step 1212, the data identified in step 1210 is processed. A conventional "Bill Type" message may include a plurality of bits indicating for each bill type, whether that bill is accepted by the bill validator/acceptor 106, e.g., "Bill Enable" bits. In an exemplary embodiment, processing unit 202 or remote processing unit 702 checks the "Bill Enable" bits of the "Bill Type" message, as similarly described in step 1102. If any of the "Bill Enable" bits is active, the sub-method proceeds to step 1214. If not, the sub-method proceeds to step 1216.

In step 1214, a second flag is activated. Conversely, in step 1206, the second flag is deactivated. In an exemplary embodiment, processing unit 202 or remote processing unit 702 maintains a "Bills Enable Flag" in a memory (e.g., memory 212). When the processor determines that any of the "Bill Enable" bits is active, the processor sets the value of the "Bills Enable Flag" to true. Conversely, when the processor determines that none of the "Bill Enable" bits are active, the processor sets the value of the "Bills Enable Flag" to false. The second sub-method then proceeds back to step 1210.

The third sub-method involves steps 1220-1226. In step 1220, the vending bus is monitored to identify data enabling or disabling a card reader. In an exemplary embodiment, the CPD 108 continuously monitors bus 102 for a "Reader Enable" or a "Reader Disable" message from VMC 100, as described in steps 300-304. A "Reader Enable" message instructs a card reader of CPD 108 to be enabled; a "Reader Disable" message instructs a card reader of CPD 108 to be disabled. Bus 102 may be a MDB, as described above. More specifically, the CPD 108 monitors bus 102 for communications, as in step 300. When a communication is received, CPD 108 identifies whether the communication is from VMC 100, as in step 302. When CPD 108 determines that the communication is from VMC 100, CPD 108 determines whether the message is a "Reader Enable" or a "Reader Disable" message.

In step 1222, the data identified in step 1220 is processed. In an exemplary embodiment, processing unit 202 or remote processing unit 702 checks the "Reader Enable" or a "Reader Disable" message. If the message is a "Reader Enable" message, the sub-method returns to step 1220. If the message is a "Reader Disable" message, the sub-method proceeds to step 1224.

In step 1224, the first and second flags are checked. In an exemplary embodiment, processing unit 202 or remote processing unit 702 checks the "Coins Enable Flag" and the "Bills Enable Flag." If either flag is set to true, the sub-method returns to step 1220. If both flags are set to false, the sub-method proceeds to step 1226.

In step 1226, a vendor out of service alert is generated. In an exemplary embodiment, the processing unit 202 or the remote processing unit 702 generates a vendor out of service alert, as described in step 1104. After the alert is generated and/or sent, the method returns to step 1200.

As described above, all three sub-methods may be performed simultaneously, or may be performed sequentially in any sequence.

As used herein, the term vending machine refers to any device or system capable of providing goods or services without the need for an attendant, including by way of non-limiting example, business work stations, customer actuated food and/or beverage dispensers, photo kiosks, DVD rental/sales devices, and gaming devices.

One or more of the functions of the various components described above may be implemented in software that controls a computer. This software may be embodied in a computer readable storage medium. Examples of computer readable storage mediums include, by way of non-limiting examples, a magnetic disk, an optical disk, a memory-card or other tangible medium capable of storing instructions.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method of generating a low coin alert for a vending machine having a vending machine controller, the method comprising:

monitoring a bus for a communication from the vending machine controller via the bus;

monitoring the bus for a response to the communication from a coin acceptor/changer to the vending machine controller via the bus;

processing the response from the coin acceptor/changer by, for each coin tube of the coin acceptor/changer, checking the response to determine a number of coins in the coin tube; and generating the low coin alert if the number of coins in the coin tube is below a predetermined threshold.

2. The method of claim 1, wherein the step of processing the response comprises:

processing the response from the coin acceptor/changer at a peripheral device coupled to the vending machine.

3. The method of claim 1, wherein the method comprises:

storing the response from the coin acceptor/changer;

transmitting the stored response to a processing unit remote from the vending machine; and processing the response from the coin acceptor/changer at the remote processing unit.

4. The method of claim 1, further comprising the step of:

transmitting the low coin alert to a remote location.

5. A method of generating a low coin alert for a vending machine having a vending machine controller, the method comprising:

monitoring a bus for a communication from the vending machine controller via the bus;

monitoring the bus for a response to the communication from a coin acceptor/changer to the vending machine controller via the bus, processing the response from the coin acceptor/changer by, for each coin tube of the coin acceptor/changer, checking the response to determine whether the coin tube is full; and generating the low coin alert if a coin tube is not full.

6. A method of generating a low coin alert for a vending machine having a vending machine controller, the method comprising:

monitoring a bus for a communication from the vending machine controller via the bus;

monitoring the bus for a response to the communication from a coin acceptor/changer to the vending machine controller via the bus, processing the response from the coin acceptor/changer using the following steps:

for each coin type of the coin acceptor/changer, checking the response to determine if a coin was deposited;

for each deposited coin, checking the response to determine if the deposited coin is routed to a cash box or to a corresponding coin tube;

for each deposited coin routed to the cash box, setting a coin counter for the coin type of the deposited coin to zero;

for each deposited coin routed to the corresponding coin tube, decrementing a coin counter for the coin type of the deposited coin if the coin counter is greater than zero;

for each coin type, checking the response to determine if a coin was dispensed; and for each dispensed coin, incrementing the coin counter for the coin type of the dispensed coin; and generating the low coin alert if the coin counter for the dispensed coin is above a predetermined threshold.

7. A method of generating a vendor out of service alert for a vending machine having a vending machine controller, the method comprising:

monitoring a bus for at least one communication from the vending machine controller via the bus;

processing the at least one communication from the vending machine controller, the at least one communication indicating coin types that are accepted; and generating the vendor out of service alert if no coin types are accepted.

8. The method of claim 7, wherein the step of processing comprises:

processing the at least one communication from the vending machine controller at a peripheral device coupled to the vending machine.

9. The method of claim 7, wherein the method comprises:

storing the at least one communication from the vending machine controller;

transmitting the stored communication to a processing unit remote from the vending machine; and processing the transmitted communication from the vending machine controller at the remote processing unit.

10. The method of claim 7, further comprising the step of:

transmitting the vendor out of service alert to a remote location.

11. The method of claim 7, wherein the at least one communication includes at least two communications, the processing step comprises processing the at least two communications; and the generating step comprises generating the vendor out of service alert based on the at least two processed communications.

12. A method of generating a vendor out of service alert for a vending machine having a vending machine controller, the method comprising:

monitoring a bus for at least one communication from the vending machine controller, the at least one communication including a first communication indicating coin types that are accepted, a second communication indicating bill types that are accepted, and a third communication enabling or disabling a card reader;

processing the first, second, and third communications by:

activating a first flag if no coin types are accepted; and activating a second flag if no bill types are accepted; and generating the vendor out of service alert if the third communication disables the card reader and if the first flag and second flag are activated.

13. A peripheral device for use with a vending machine having a vending machine controller, at least one other peripheral device, and a bus interconnecting the vending machine controller and the at least one other peripheral device, the peripheral device comprising:

a bus interface configured to receive data from the bus and to transmit data onto the bus; and a processing unit coupled to the bus interface, the processing unit programmed to generate a low coin alert for the vending machine by:

monitoring the bus for a communication from the vending machine controller via the bus;

monitoring the bus for a response to the communication from a coin acceptor/changer to the vending machine controller via the bus;

processing the response from the coin acceptor/changer by, for each coin tube of the coin acceptor/changer, checking the response to determine a number of coins in the coin tube; and generating the low coin alert if the number of coins in the coin tube is below a predetermined threshold.

14. The device of claim 13, further comprising:

a memory configured to store the data received from the at least one other peripheral device; and a transceiver configured to transmit the stored data to a processing unit remote from the vending machine.

15. The device of claim 14, wherein the transceiver is further configured to transmit the alert to a remote location.

16. A peripheral device for use with a vending machine having a vending machine controller, at least one other peripheral device, and a bus interconnecting the vending machine controller and the at least one other peripheral device, the peripheral device comprising:

a bus interface configured to receive data from the bus and to transmit data onto the bus; and a processing unit coupled to the bus interface, the processing unit programmed to generate a low coin alert for the vending machine by:

monitoring the bus for a communication from the vending machine controller via the bus;

monitoring the bus for a response to the communication from a coin acceptor/changer to the vending machine controller via the bus;

processing the response from the coin acceptor/changer by, for each coin tube of the coin acceptor/changer, checking the response to determine whether the coin tube is full; and generating the low coin alert if a coin tube is not full.

17. A peripheral device for use with a vending machine having a vending machine controller, at least one other peripheral device, and a bus interconnecting the vending machine controller and the at least one other peripheral device, the peripheral device comprising:

a bus interface configured to receive data from the bus and to transmit data onto the bus; and a processing unit coupled to the bus interface, the processing unit programmed to generate a low coin alert for the vending machine by:

monitoring the bus for a communication from the vending machine controller via the bus;

monitoring the bus for a response to the communication from a coin acceptor/changer to the vending machine controller via the bus;

processing the response from the coin acceptor/changer using the following steps:

for each coin type of the coin acceptor/changer, checking the response to determine if a coin was deposited;

for each deposited coin, checking the response to determine if the deposited coin is routed to a cash box or to a corresponding coin tube;

for each deposited coin routed to the cash box, setting a coin counter for the coin type of the deposited coin to zero;

for each deposited coin routed to the corresponding coin tube, decrementing a coin counter for the coin type of the deposited coin if the coin counter is greater than zero;

for each coin type, checking the response to determine if a coin was dispensed; and for each dispensed coin, incrementing the coin counter for the coin type of the dispensed coin; and generating the low coin alert if the coin counter for the dispensed coin is above a predetermined threshold.

18. A peripheral device for use with a vending machine having a vending machine controller, at least one other peripheral device, and a bus interconnecting the vending machine controller and the at least one other peripheral device, the peripheral device comprising:

a bus interface configured to receive data from the bus and to transmit data onto the bus; and a processing unit coupled to the bus interface, the processing unit programmed to generate a vendor out of service alert for the vending machine by:

monitoring the bus for at least one communication from the vending machine controller via the bus;

processing the at least one communication from the vending machine controller, the at least one communication indicating coin types that are accepted; and generating the vendor out of service alert if no coin types are accepted.

19. A peripheral device for use with a vending machine having a vending machine controller, at least one other peripheral device, and a bus interconnecting the vending machine controller and the at least one other peripheral device, the peripheral device comprising:

a bus interface configured to receive data from the bus and to transmit data onto the bus; and a processing unit coupled to the bus interface, the processing unit programmed to generate a vendor out of service alert for the vending machine by:

monitoring the bus for at least one communication from the vending machine controller, the at least one communication including a first communication indicating coin types that are accepted, a second communication indicating bill types that are accepted, and a third communication enabling or disabling a card reader;

processing the first, second, and third communications by:

activating a first flag if no coin types are accepted; and activating a second flag if no bill types are accepted; and generating the vendor out of service alert if the third communication disables the card reader and if the first flag and second flag are activated.

* * * * *